United States Patent [19]

Pytlarz et al.

[11] 4,195,315

[45] Mar. 25, 1980

[54] LOCKABLE ADJUSTMENT MEANS FOR SELF-CONVERGING ADJUSTABLE YOKE ASSEMBLY

[75] Inventors: Charles P. Pytlarz, Lake Zurich; Richard L. Rost, Barrington, both of Ill.

[73] Assignee: Zenith Radio Corporation, Glenview, Ill.

[21] Appl. No.: 947,130

[22] Filed: Sep. 29, 1978

[51] Int. Cl.[2] ..... H01F 15/02

[52] U.S. Cl. ..... 358/248; 335/213

[58] Field of Search ..... 358/248, 249; 335/212, 335/213

[56] References Cited

U.S. PATENT DOCUMENTS

| | | | |
|---|---|---|---|
| 3,786,185 | 1/1974 | Shrader | 358/248 |
| 4,006,301 | 2/1977 | Bubacz | 358/248 |
| 4,064,543 | 12/1977 | Phillips et al. | 358/248 |
| 4,110,793 | 8/1978 | Tajiri | 358/248 |
| 4,117,516 | 9/1978 | Yasuhara | 358/248 |
| 4,130,836 | 12/1978 | Kornaker | 358/248 |
| 4,151,561 | 4/1979 | Kratz | 358/248 |

FOREIGN PATENT DOCUMENTS

| | | | |
|---|---|---|---|
| 2652865 | 5/1978 | Fed. Rep. of Germany | 358/249 |

*Primary Examiner*—Howard W. Britton
*Assistant Examiner*—Michael A. Masinick

[57] ABSTRACT

A self-converging adjustable yoke assembly comprises a lightweight plastic liner, sandwiched between saddle type horizontal coils and toroidal type vertical coils, with an attached rear for clamping the assembly on the neck of a picture tube. The periphery of the liner has three symmetrically mounted adjustment means each comprising a support base cemented to the yoke liner and to the horizontal windings, an adjustment screw having a hexagonal ball head and a locking cap. The adjustment screws engage the funnel of the picture tube for adjusting yoke tilt about the tube axis. The locking caps releasably secure the adjustment screws in position.

7 Claims, 12 Drawing Figures

LOCKABLE ADJUSTMENT MEANS FOR SELF-CONVERGING ADJUSTABLE YOKE ASSEMBLY

CROSS REFERENCE TO RELATED PATENT APPLICATION

This application discloses apparatus claimed in copending application Ser. No. 939,510, filed Sept. 5, 1978 and assigned to Zenith Radio Corporation.

FIELD OF THE INVENTION

This invention pertains generally to television receiver deflection yokes, and specifically to adjustment means for securing television receiver deflection yokes of the self-converged type in desired position on the picture tube neck.

BACKGROUND OF THE INVENTION AND PRIOR ART

Electromagnetic deflection yokes have been used for many years, and their technology is well defined. The electromagnetic field through which an electron beam in a cathode ray tube travels on its journey from the electron gun in the tube neck to the phosphor target at the viewing screen determines the sweep or deflection pattern it experiences. Normally simultaneous horizontal and vertical deflection is effected to produce a raster of illuminated phosphor. With monochrome picture tubes, the shape and position of the pattern is not as critical as it is with color picture tubes because the latter actually have three electron beams producing corresponding patterns which must be converged throughout.

For many years, a delta or triangular arrangement of electron guns has been used in conjunction with a shadow mask positioned close to a screen consisting of a mosaic of different colored light-emitting phosphor elements. As is well known, the shadow mask apertures shield or "shadow" each color deposit from beams from two of the three electron guns, allowing it to be impacted only by the beam from its associated gun. Thus (ideally) the "red" beam only strikes the red phosphor deposits, the "blue" beam only the blue deposits and the "green" beam only the green deposits.

Tri-color tubes have historically required numerous external mechanisms for converging the electron beams at the shadow mask throughout the tube viewing area. A principal reason is that the electron beam sources are not located at the origin of the sphere defined by the radius of curvature of the picture tube target screen which results in the electron beams travelling farther as the deflection angle increases .

A vast simplification in external convergence hardware has been made possible by the development of the so-called in-line type electron gun. Indeed, with proper design of the deflection yoke, in-line gun picture tubes can be made that require no external convergence apparatus. However, there are constraints placed on yoke positioning. In delta gun picture tubes positioning of the yoke along the tube neck was required. In "self-converged" in-line type tubes the yoke axis must also be movable with respect to the tube axis to achieve convergence. These movements take the form of vertical and horizontal tilt adjustments, which physically offset the yoke from the tube axis until the electron beams coincide with the phosphor deposits.

There are three basic yokes types; the saddle, the toroid, and the hybrid. In a saddle type, both the horizontal and vertical deflection coils are formed to the approximate contour of the picture tube funnel-neck area and arranged within a liner surrounded by a magnetic core. In the toroid form the windings are wound around the core in the direction of its central axis. The hybrid yoke generally has a saddle horizontal deflection coil and a toroidal vertical coil. All yokes employ an insulation liner of some type for at least securing the yoke assembly to the tube neck. In toroid yokes of the so-called precision type, the positions of the individual coil turns are maintained within close tolerances, and their liners are quite rigid often with peripheral serrations to securely position the individual winding turns.

Most in-line picture tubes use self-converged deflection yokes (either the toroid or hybrid type), and the necessary yoke tilt adjustments are made and held by exerting appropriate forces on the peripheral areas of the yoke assembly, generally the edges of the funnel end of the liner.

One prior art structure comprises a full toroid yoke which the manufacturer physically cements in position on the picture tube. Such a structure is exemplified by U.S. Pat. No. 3,786,185 issued Jan. 15, 1974 and includes an annular platform separately cemented to the funnel of the picture tube. This provides a surface for tilting the yoke assembly (with suitable means) until the desired operational yoke-tube relationship is obtained. The entire assembly is then cemented into position. The yoke is not thereafter adjustable and both the yoke assembly and the picture tube are replaceable as a unit. In this system, there is no positive clamp support for the yoke assembly on the tube neck. The platform provides the sole support for the yoke assembly.

U.S. Pat. No. 4,006,301, issued Feb. 1, 1977, shows a hybrid yoke and also includes a platform or ring which is cemented to the funnel of the picture tube and provides a surface with respect to which the yoke assembly may be tilted for proper orientation about the tube axis. Here the cemented platform supports the yoke assembly in conjunction with a clamp on the rear of the yoke assembly housing which anchors it to the tube neck. A plurality of wedges are used to tilt the liner of the yoke assembly with respect to the tube axis by forcing wedges between the platform and the liner front. The entire assembly is constructed of plastic with the wedges being slidably retained in place by a ratchet and locking mechanism. The wedges may be released for readjustment of yoke tilt by operation of release tabs. This system works well, is reasonably economical, but suffers from its two-piece construction and physical size. Its two-piece construction precludes complete fabrication of the yoke assembly at a single manufacturing facility because one of the pieces must be attached to the picture tube during final assembly of the television receiver. Its size makes the unit very difficult, if not impossible, to use with small tubes because of the limited rear access space available in such receivers.

Other adjustment devices which are self-container, i.e.; do not have separate parts or pieces that must be cemented to the tube, are known in the art. In particular, one manufacturer includes a heavy, rigid plastic liner having three screw-bearing attachments which are positioned about, and locked into place on, the periphery of the funnel portion of the liner. The screws are made of plastic and include ends for contacting the picture tube funnel and slotted heads for screwdriver adjustment thereof. In conjunction with the yoke housing clamp, which secures the rear of the assembly to the neck of the picture tube, the screws provide tilt adjustments for the yoke assembly with respect to the tube axis. The screws are maintained in the desired position by cementing their threaded portions. While the cement bond may be broken for readjustment, this is not easily accomplished and the glue set-up time can adversely affect the receiver assembly line.

Another structure utilizes a much lighter weight liner with a plurality of molded holes for reception of small screws. A heavy ring with six adjustment screw support members (only three of which are used) is attached to the liner by a number of these small screws. The tilt adjustment screws are similar to the ones mentioned above and are also cemented to lock them in position when the desired yoke tilt is achieved.

While these latter two self-contained structures facilitate rapid and positive tilt adjustments, they are very expensive and lack a convenient method for subsequent readjustment of the yoke. In both yoke structures, the tilt screws are positioned to orthogonally intersect the funnel surface. Consequently the screws are set at about a 120° angle to the front surface of the liner. This makes it difficult to reach the slotted ends for readjustment when the tube is mounted to its chassis. These and other problems of the prior art structures are overcome in a facile and economical manner with the adjustment means of the invention.

SUMMARY OF THE INVENTION

In accordance with the invention a low-cost self-converging deflection yoke and mounting system comprises a flexible plastic liner sandwiched between horizontal and vertical deflection coils, clamp means for securing the liner to the neck of the picture tube and screw adjustment means mounted to the liner for abutting engagement with the funnel of a picture tube. Rotation of the screw adjustment means tilt the yoke on the picture tube neck and alter its axial position with respect to the tube axis. Lock means are operable for releasably securing clamp means for changing the attitude of the yoke with respect to the adjustment means in position.

OBJECTS OF THE INVENTION

A primary object of this invention is to provide an improved self-converging yoke assembly.

A further object of this invention is to provide a self-converging yoke assembly of lower cost and greater operational ease.

Further objects and advantages of the invention will be apparent from a reading of the description of the preferred embodiment thereof in conjunction with the drawings in which:

FIG. 1 pictorially shows a yoke assembly constructed in accordance with the invention mounted on a picture tube;

DESCRIPTION OF THE PREFERRED EMBODIMENT

Figure 1:
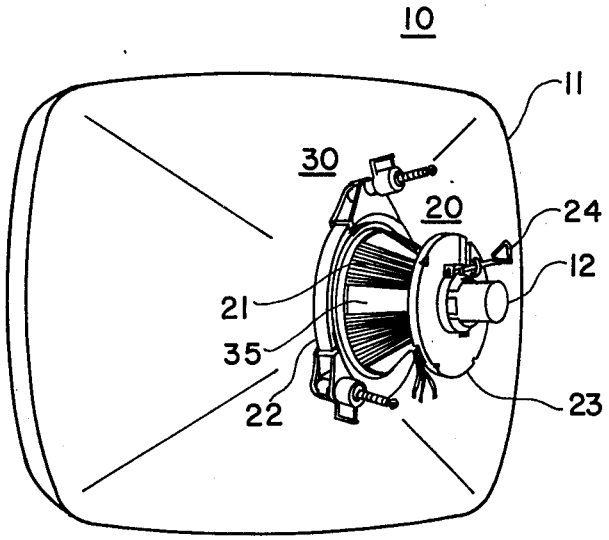

In FIG. 1 a color picture tube 10 has a curved funnel 11 terminating in a centrally disposed cylindrical neck 12. The color tube is of conventional design and includes a viewing screen consisting of a mosaic of red, blue, and green colored light-emitting phosphor deposits, a shadow mask positioned close to the screen and three in-line electron guns mounted in neck 12. A self-converging yoke assembly 20, constructed in accordance with the invention, is positioned on neck 12 with its large, funnel end in close proximity to the funnel of the tube. The yoke is a hybrid having saddle type horizontal windings (not shown) and toroid vertical windings 21 wound about a magnetically permeable core 35. A lightweight plastic liner 22 is interposed between the horizontal windings, and the vertical windings and core. A conventional rear housing 23 is affixed to liner 22 by any suitable means and has extending flanges secured by a clamp 24 to the neck of the picture tube. Three adjustment means 30 are symmetrically displaced about the periphery of liner 22. The yoke assembly is oriented on neck 12 with the adjustment means occupying 90°, 120°, and 240° angular positions.

Figure 2:
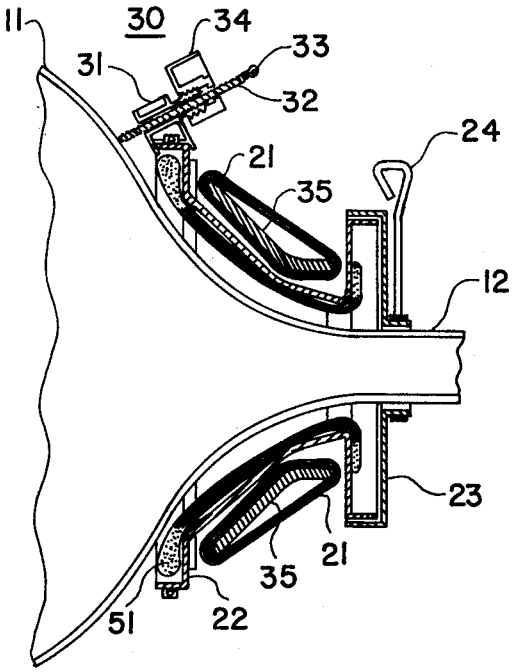
FIG. 2 is an enlarged partial cross section of the yoke assembly and tube taken along the longitudinal axis of the tube.

In FIG. 2 a cross section of the yoke assembly and part of the picture tube is shown to more clearly illustrate the arrangement of the adjusting means 30 with respect to liner 22 and their coaction with clamp 24 in retaining the yoke assembly in fixed position on tube 10. It also depicts the relative positions of vertical windings 21, core 35, liner 22, and horizontal windings 51, as well as some details of rear housing 23, clamp 24 and picture tube neck 12. The adjusting means each include a support base 31 forming a threaded aperture in which an adjustment screw 32 is operably movable. Adjustment screw 32 has a head 33 engageable by a suitable driving tool (not shown) over a very wide drive angle. A locking device 34 cooperates with base 31 and adjustment screw 32 to retain the screw in position after the yoke has been satisfactorily positioned with respect to the tube axis.

Figure 3F:
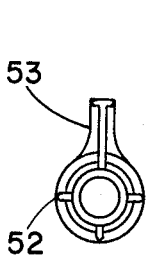
FIGS. 3A–3F show various views of a support base and locking cap.
Figure 3E:
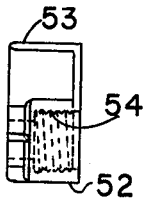
Figure 3D:
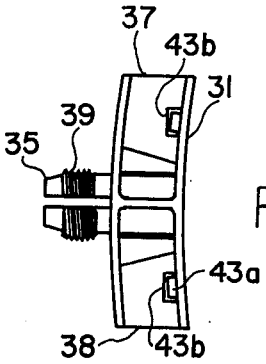
Figure 3B:
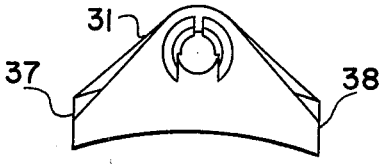
Figure 3A:
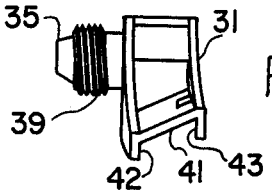
Figure 3C:
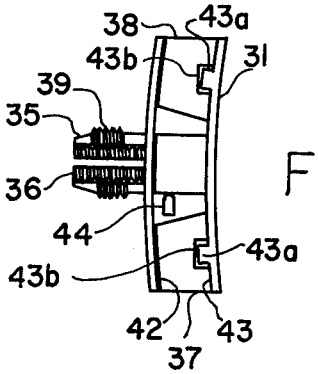

FIG. 3A is a side view showing support base 31 in more detail. FIG. 3B is a view of FIG. 3A from the left, and FIGS. 3D and 3C top are bottom view of FIG. 3A. Base 31 includes a split collet extending above a generally A-shaped body. Collet 35 actually has two "splits", with the upper one being fairly narrow (FIG. 3D) and the lower one relatively wide (FIG. 3C). The collet has an inner threaded surface 36 and an outer threaded surface 39. The inner threaded surface cooperates with the threaded body of adjustment screw 32. A locking device 34 which in FIGS. 3E and 3F includes a cap 52, defining an inner threaded surface 54, and a flange serving as a handle 53. Threaded surface 54 cooperates with the outer threaded surface of the split collet such that, when the cap is turned in a clockwise or tightening direction, the walls of the split collet are forced inward. This results in squeezing the inner threaded surface of the collet and the threaded body of the adjustment screw together and effectively locks the screw in position. Handle 53 is provided to enable the locking device to be operated in "close quarters".

Support base 31 includes an arcuate surface 41 conforming to the radius of curvature of the periphery of liner 2 and inclined to the front and rear surfaces of the base such that, when positioned on the liner, the adjustment screw orthogonally approaches the surface of the picture tube funnel. The base includes a pair of inner surfaces 42 and 43 for cooperation with corresponding surfaces on the liner. As will be seen, each base is snapped over the liner edge and positioned against one of the locating stops formed in the liner. It is then held in place by cementing it to the liner. Each support base includes a pair of tabs 43*a* extending from surface 43. These tabs cooperate with arcuate surface 41 to sandwich the edge of the liner and provide a "positioning" bond to hold the parts while the glue is drying. Apertures 43*b* are required in the molding process by which support base 31 is made and serve no purpose in the invention.

Figures 4A, 4B:
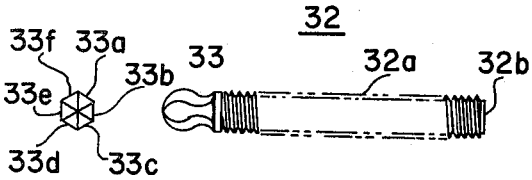
FIGS. 4A and 4B show details of the adjustment screw.

FIGS. 4A and 4B show one of the adjustment screws 32 in detail. The screw includes a threaded body 32*a* (which preferably consists of a large-pitch double thread for obtaining rapid advance in the split collet), a funnel engaging surface 32*b* at one end and a wide-angle drive head 33 at its other end. As shown clearly in FIG. 4B, the shape of drive head 33 is that of a "hexagonal ball" having surfaces 33*a*–33*f* which project as a regular hexagon over a large viewing angle and permits the head to be driven by a standard socket drive tool over a similarly wide solid drive angle. This provision facilitates use of the adjusting means even in environments with limited rear accessibility, such as are encountered with small screen television receivers.

Figure 5:
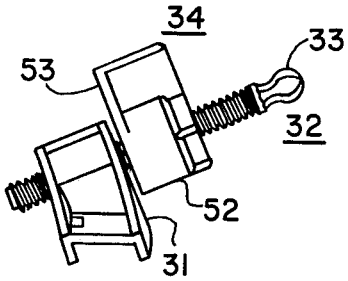
FIG. 5 is a side view of an assembled support base, adjustment screw and locking cap.

FIG. 5 illustrates an assembled adjustment device and clearly shows the operational relationship between support base 31, adjustment screw 32 and locking device 34. All parts are preferably molded of plastic for both weight and economic considerations.

Figure 6:
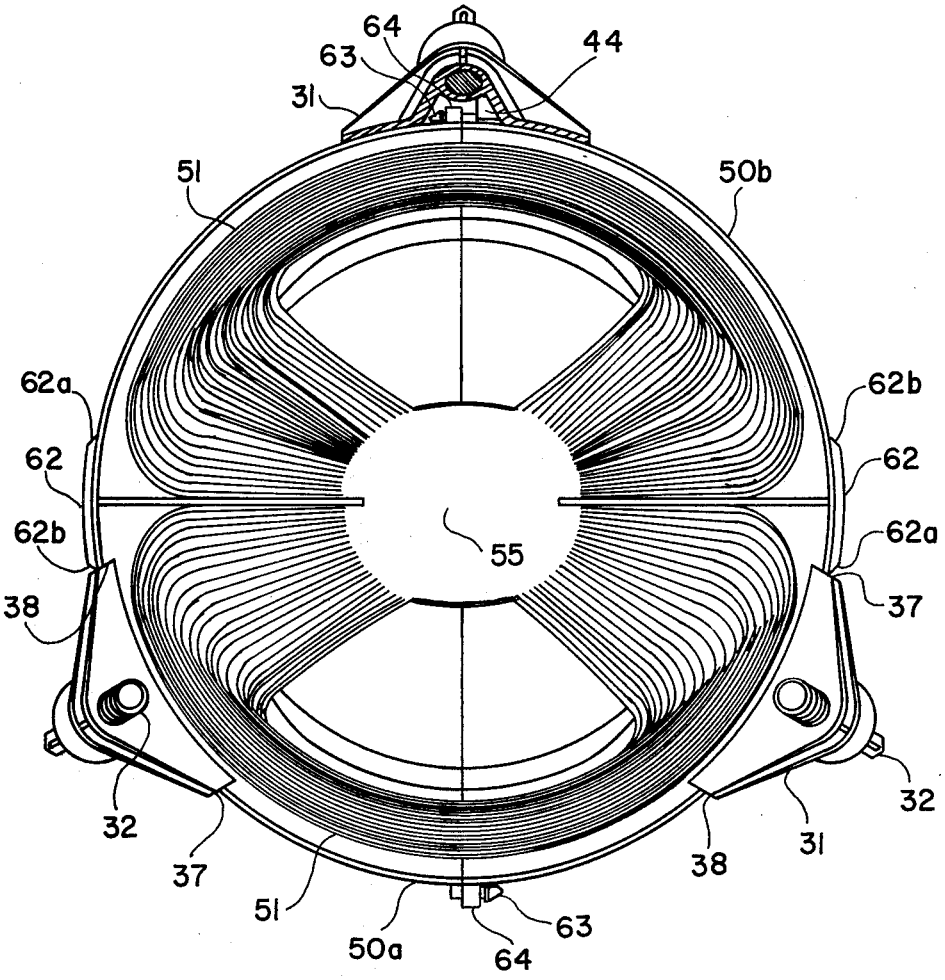
FIG. 6 is a funnel end view of the yoke assembly showing the identical halves of the liner, arrangement of the horizontal coils and cementing of the liner, base supports and horizontal coils.

In FIG. 6 an inner frontal view of the yoke assembly shows some of its construction details. In particular the form and positioning of the saddle wound horizontal windings 51 with respect to liner 22 is illustrated. The saddle windings are wound on an appropriately shaped form and cemented such that the windings become rigid and self-supporting. The liner is molded in two identical halves 50*a* and 50*b*, each with a centrally disposed peripheral tab 62 of a length such that its edge surfaces 62*a* and 62*b* serve as locating stops for the adjustment means bases, an edge of which abuts a corresponding tab when correctly positioned. The liner portions are attached to each other by means of simple molded plastic "bolt and clasp" fasteners formed at the outermost portions of their mating surfaces. The "bolt" comprises a small extension 63 terminating in an "arrowhead" and the "clasp" comprises a split U-shaped "collar" 64 which spreads slightly to receive the extension. As is seen more clearly in the partially sectioned upper adjustment means, the rear surface of extension 63 also provides a locating surface cooperating with an inner stop 44 to correctly position base 31.

In operation, the liner halves are joined during assembly of the yoke proper. After installation of the windings, core etc., the adjusting means are installed by snapping the base over the liner edge in the 90° (or 270°) position with stop 44 abutting the rear surface of extension 63. Another adjusting means base is positioned with its edge 38 abutting edge 62*b* of tab 62 and the last base with its edge 37 abutting edge 62*a* of the other tab 62. The adjusting means are then cemented into place and the liner cemented to the horizontal windings. As mentioned previously, the vertical windings and core are cemented to the liner and any movement between their contacting surfaces is precluded. Also cementing the horizontal windings to the liner thus lends a great deal more rigidity and support to the liner, which is important because the adjusting means support bases are affixed to the liner edge and transmit forces from the adjustment screws. By cementing the entire yoke assembly together the liner may be constructed of very lightweight material which minimizes cost and reduces weight while retaining essential rigidity. The cement for the winding is preferably heat-settable with high electrical breakdown properties to preclude disturbing the yokes's electrical characteristics.

What has been described is a novel self-contained adjustable yoke assembly of the self-converging variety. It is recognized that modifications in the embodiments illustrated may be made by those skilled in the art without deporting from the true spirit and scope of the invention as set out in the claims.

What is claimed is:

1. For use in a color television receiver including a picture tube having a funnel and a neck;

a low-cost self-converging beam deflection yoke and mounting system adapted to fit on said neck in close proximity to said funnel, said deflection yoke having a flexible plastic liner sandwiched between pairs of appropriately shaped horizontal and vertical deflection coils and including clamp means for securing said liner to the neck of the picture tube;

screw adjustment means mounted to said liner for abutting engagement with said funnel, rotation of said screw adjustment means tilting said yoke on said neck and altering its axial position with respect to the tube axis; and lock means for releasably securing said screw adjustment means in position.

2. A deflection yoke as set forth in claim 1 wherein said screw adjustment means include;

a plurality of generally A-shaped plastic support bases each having a threaded aperture therethrough:

a set of mounting tabs on each said support base engageable with the edge of the funnel end of said plastic liner;

and an adjustment screw rotatable within said threaded aperture.

3. A deflection yoke as set forth in claim 2 wherein each support base includes a shoulder forming a split collet in axial alignment with said threaded aperture and having an external threaded surface, said adjustment screw extending through said split collet.

4. A deflection yoke as set forth in claim 3 wherein said lock means comprise a corresponding plurality of internally threaded caps each engageable with a respective collet and having a clearance aperture for passage of said screw.

5. A deflection yoke as set forth in claim 4 wherein double threads are utilized for rapid advancement.

6. A deflection yoke as set forth in claim 2 wherein each said adjustment screw includes a first end cooperating with the funnel of said picture tube for axially positioning said yoke on said neck and a second end cooperable with a drive tool through a large range of drive angles.

7. A deflection yoke as set forth in claim 6 wherein said second end comprises a hexagonal ball head for cooperation with a conventional hexagonal drive socket of similar size.

* * * * *